United States Patent [19]

Hackbart

[11] 4,432,693

[45] Feb. 21, 1984

[54] CENTRIFUGAL PUMP IMPELLER

[75] Inventor: Reuben J. Hackbart, La Crosse, Wis.

[73] Assignee: The Trane Company, La Crosse, Wis.

[21] Appl. No.: 349,799

[22] Filed: Feb. 18, 1982

[51] Int. Cl.[3] ..... F04D 1/12; F01M 1/02

[52] U.S. Cl. ..... 415/88; 417/372; 184/6.18; 184/31; 416/179

[58] Field of Search ..... 415/83, 88, 143, 199.1; 416/179; 417/368, 369, 372, 902; 184/6.16, 6.18, 31

[56] References Cited

U.S. PATENT DOCUMENTS

| | | | |
|---|---|---|---|
| 2,493,467 | 1/1950 | Sunnen | 415/199.1 |
| 3,396,903 | 8/1968 | Oya . | |
| 3,563,677 | 2/1971 | Retan | 417/415 |
| 3,610,784 | 10/1971 | Rundell | 417/415 |
| 3,926,281 | 12/1975 | Hannibal | 417/372 X |
| 3,934,967 | 1/1976 | Gannaway | 417/271 |
| 4,131,396 | 12/1978 | Privon et al. | 417/902 X |

*Primary Examiner*—Stephen Marcus

*Assistant Examiner*—Joseph M. Pitko

*Attorney, Agent, or Firm*—Carl M. Lewis; Ronald M. Anderson; Raymond W. Campbell

[57] ABSTRACT

An impeller for a centrifugal oil pump having improved head and flow output capabilities, which impeller can be machined into the end of a crankshaft. A plurality of radially extending tunnels are disposed horizontally in the crankshaft, with outlets in the perimeter of the crankshaft. An annular groove is provided in the crankshaft, with a groove opening in the bottom surface of the crankshaft and a subtending groove surface defining the depth of the groove. The subtending groove surface is normally narrower than the groove opening, and the groove intersects the tunnels, exposing a part of the tunnel walls to a flow of fluid from directly below. The exposed tunnels act as vanes to scoop oil from the groove and accelerate it to crankshaft speed. Entrained gases collect near the subtending groove surface, and a vent passage is provided to conduct the gases out of the impeller.

19 Claims, 10 Drawing Figures

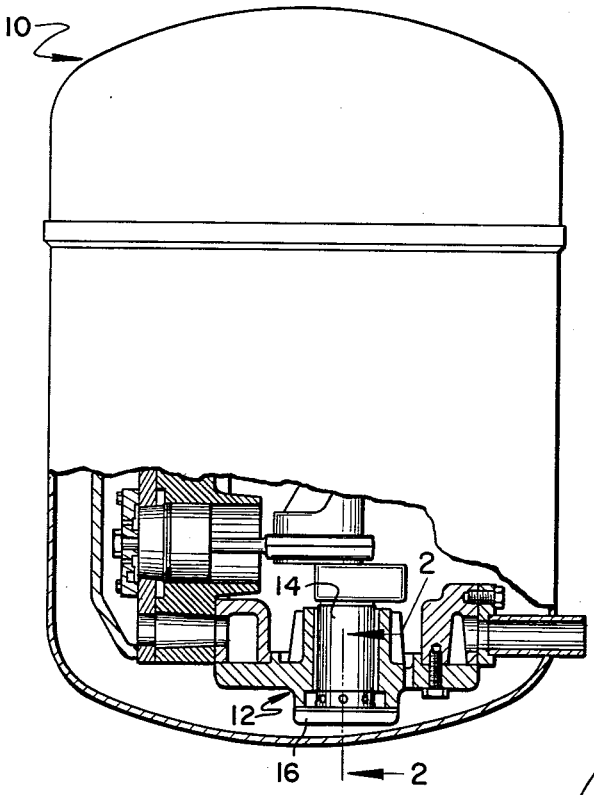
FIG. 1
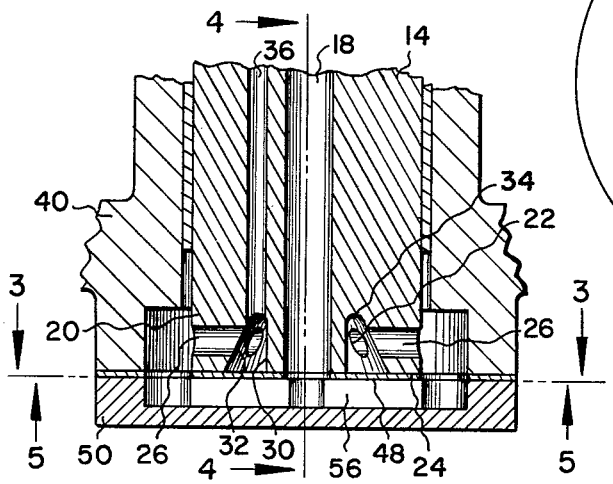
FIG. 2
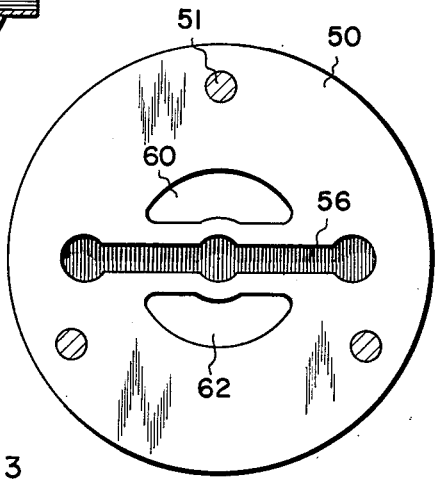
FIG. 3
FIG. 10
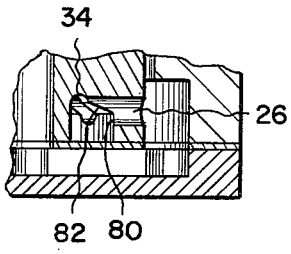

CENTRIFUGAL PUMP IMPELLER

DESCRIPTION

1. Technical Field

The present invention pertains generally to the field of centrifugal fluid pumps and specifically to the field of centrifugal oil pumps for reciprocating compressors.

2. Background Art

Vertically oriented reciprocating compressors frequently include a centrifugal oil pump for supplying a flow of oil to lubricate bearings and other moving parts. The oil is drawn from a sump and rises in a longitudinal bore of the crankshaft, and from the bore the oil is distributed to the bearing surfaces. The performance of a centrifugal pump is related to the speed of the crankshaft, with increased performance resulting from faster crankshaft speeds.

Various types of centrifugal pumps have been used in the past, including both simple and relatively complex impelling means. In the refrigeration compressor described in U.S. Pat. No. 3,934,967 the drive shaft includes an inclined longitudinal bore, the opening of which is disposed in oil in an oil sump of the compressor. Rotation of the shaft results in oil being drawn upwardly in the bore. A tapered bore eccentric to the axis of the shaft is shown and described in U.S. Pat. No. 3,396,903. A cone-shaped imepller body is shown in U.S. Pat. No. 3,610,784 for supplying oil to the bore, and U.S. Pat. No. 3,563,677 discloses a dome-shaped impeller. The last-mentioned patent also discloses an angular disc in the "dome" for aiding in impelling the oil.

Somewhat more complex, two-stage centrifugal pumps have also been used. The impeller can be machined in the end of the crankshaft and includes an annular inlet groove in the bottom end of the shaft, which groove communicates with radial holes extending horizontally to the perimeter of the pump. In prior two-stage centrifugal pumps the annular inlet grooves have had substantially parallel side walls perpendicular to the end surface of the crankshaft. Oil in the annular groove is thrown outwardly through the radial holes by centrifugal force, and the oil is collected in chambers of a housing surrounding the bottom of the crankshaft. From the chamber the oil flows into a channel of an end plate and is conveyed to the bore of the crankshaft, through which it is transmitted to the bearings for lubricating the compressor. For the most part, these types of pumps perform adequately in relatively high-speed compressors; however, since the performance of a pump is related to the speed of the crankshaft, the performances of prior designs for centrifugal pumps have proved to be inadequate for slower speed compressors. For adequate lubrication of the upper bearings in slow speed compressors, the prior types of centrifugal pumps must perform at, or near, peak efficiency, which is not always attainable in an operating system.

To increase the pumping capabilities of centrifugal pumps, various types of vanes have been used in the inlet region of the pump. The vanes act as scoops to capture oil from the sump. Although the addition of vanes increases the pump performance, various disadvantages are also associated with the use of vanes. Permanent attachment of the vanes in the inlet region is crucial in that detachment of a vane can result in substantial damage to the compressor. Further, the vanes are positioned angularly in the pump, to scoop the oil from the sump efficiently. If the compressor is operated in a reverse direction to the intended direction, the pump will not perform, and severe compressor damage can occur quickly. Thus, an inadvertent installation error can result in significant, and costly compressor damage.

SUMMARY OF THE INVENTION

It is therefore one of the principal objects of the present invention to provide a centrifugal oil pump having improved head and flow performance, for providing adequate lubrication of upper bearings in slow speed compressors.

Another object of the present invention is to provide an impeller for a centrifugal oil pump which can be machined or otherwise formed in the end of a crankshaft to increase pump performance without using separately attached vanes, thereby eliminating the potential for vane detachment and compressor damage resulting therefrom.

A further object of the present invention is to provide a centrifugal oil pump which performs equally well in either direction of crankshaft rotation, thereby assuring lubrication of the compressor bearings even in the face of installation error, and which vents entrained gases adequately to prevent vapor lock in the pump.

These and other objects are achieved in the present invention by providing an oil impeller machined in the end of a compressor crankshaft, the impeller having an annular inlet groove and a plurality of radially extending horizontal tunnels. The groove has a groove opening in the bottom surface of the crankshaft and a subtending surface narrower than the opening for defining the depth of the groove. The groove intersects the tunnels in a manner to expose a part of the tunnel walls to fluid flow from directly below. In one embodiment the entire outer side wall of the groove angles inwardly across the tunnels, and in a second embodiment the outer side wall includes a first section perpendicular to the bottom surface of the crankshaft, extending from the bottom surface to the plane of the bottom of the tunnels, and a second section of the outer side wall angles inwardly from the aforementioned plane to near a plane defined by the midline of the tunnels. The remainder of the outer side wall is generally perpendicular to the bottom surface. The subtending groove surface is generally concave, forming a region in which entrained gases can collect above the upper level of the tunnels when the crankshaft is vertically disposed. A vent opening from the region allows the gases to escape from the pump, preventing cavitation or vapor lock. The oil in the groove is transmitted outwardly through the tunnels, is collected in chambers in a housing surrounding the impeller, and the oil is transmitted through a seal to a channel in the pump end plate for transmittal upwardly in an axial bore of the crankshaft in conventional fashion during operation of a pump using the impeller.

Further objects and advantages of the present invention will become apparent from the detailed description and the accompanying drawings.

BRIEF DESCRIPTION OF THE DRAWINGS

FIG. 1 is an elevational view, partially broken away, and in partial cross-section, of a reciprocating compressor having a centrifugal oil pump embodying the present invention.

FIG. 2 is a cross-sectional view of the oil pump shown in FIG. 1, taken on line 2—2 of the latter figure.

FIG. 3 is a horizontal cross-sectional view of the pump taken on line 3—3 of FIG. 2.

FIG. 10 is a fragmentary cross-sectional view of another modified form of the invention.

DETAILED DESCRIPTION OF THE PREFERRED EMBODIMENT

Figure 4:
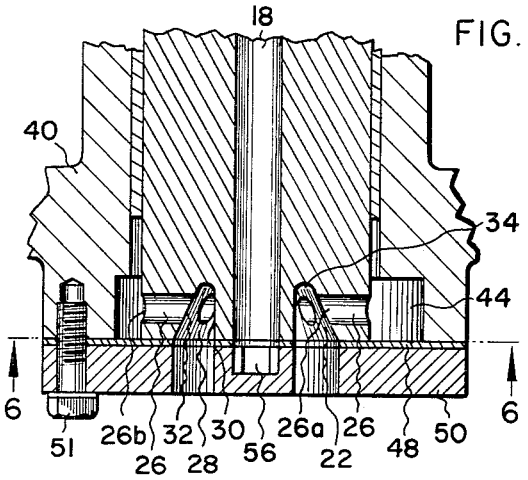
FIG. 4 is a vertical cross-sectional view of the centrifugal oil pump taken on line 4—4 of FIG. 2.
Figure 5:
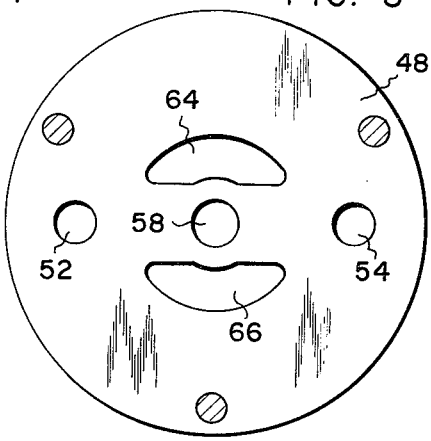
FIG. 5 is a horizontal cross-sectional view of the centrifugal oil pump shown in FIG. 2, taken on line 5—5 of the latter figure.
Figure 6:
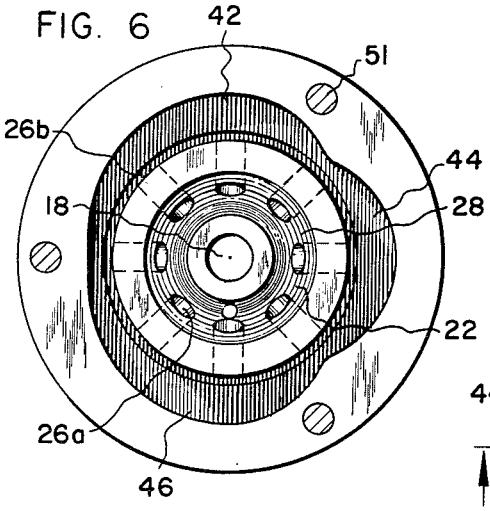
FIG. 6 is a cross-sectional view of the pump shown in FIG. 4, taken on line 6—6 of FIG. 4.

Referring now more specifically to the drawings, and to FIG. 1 in particular, numeral 10 designates a reciprocating compressor having a centrifugal oil pump 12 embodying the present invention, the pump being disposed on the lower end of a vertically oriented crankshaft 14. The pump operates in a sump 16 which contains oil, and the oil moved by pump 12 rises in an axial bore 18 of the crankshaft to the lubrication sites of the compressor.

Pump 12 includes an oil impeller, generally designated by the numeral 20, which is disposed on the end of the crankshaft and turns as the crankshaft turns to capture oil from the sump and propel it outwardly by centrifugal force. Impellers of the present invention can be formed on the end of the crankshaft, as an integral part of the crankshaft, by machining or other fabricating techniques. An annular groove 22 is provided in a substantially planar bottom surface 24 of the impeller, and a plurality of radially extending tunnels 26 are disposed between the annular groove and the perimeter of the impeller. The tunnels shown in the drawings are substantially horizontal and include tunnel inlet and outlet openings 26*a* and 26*b* respectively. The inlets are disposed inwardly in the impeller from the end or bottom surface 24 and are radially outward from bore 18. The outlets are disposed in the periphery of the impeller. Oil in the sump can flow into the groove through a groove opening 28 and is propelled outwardly to the perimeter of the impeller through tunnels 26. In the embodiment shown in FIGS. 1 through 6, the annular groove is defined by an inner wall 30 substantially perpendicular to the plane bottom surface 24, an outer wall 32 which is disposed angularly relative to the planar bottom surface, and a concave subtending groove surface 34 between the inner and outer walls. The subtending groove surface can be of shapes other than the concave shape shown, which has been chosen primarily for manufacturing ease. Tunnels 26 and groove 22 intersect near, but in spaced relation to the concave subtending groove surface 34, and when the impeller is operated in a vertical position as most clearly shown in FIGS. 2 and 4, gases entrained in the oil can collect in the area above the tunnels which is generally defined by the subtending groove surface. A vent passage 36 is disposed in the crankshaft and a vent outlet from the passage enables the gases to escape from the pump, thereby preventing cavitation or vapor lock.

Tests have shown that the dimensional specifications of the impeller can be varied, with differing effects on the pump performance. Thus, the depth and width of the annular groove, the diameter and number of tunnels, and the angle of the outer wall relative to the bottom surface of the impeller can be varied to meet existing physical limitations imposed by the environment in which the impeller will operate. Some variations have been found to perform better or worse than other variations under different conditions, such as crankshaft speed, desired head, desired flow and the like.

Keeping in mind the great versatility available, some of the specifications will be given for one impeller found to work satisfactorily. A crankshaft having a length of 22.6 (twenty-two and six-tenths) inches and operating at 1750 (one-thousand seven-hundred fifty) r.p.m. is vertically disposed in a reciprocating compressor, and an axial bore in the crankshaft distributes the lubricating oil. The impeller annular inlet groove has a groove opening about 0.68 (sixty-eight hundredths) inch wide, with inner and outer diameters of 0.72 (seventy-two hundredths) inch and 1.40 (one and forty hundredths) inches, respectively, and the groove has a maximum depth of 0.40 (forty hundredths) inch. The midlines of the tunnels are 0.26 (twenty-six hundredths) inch from bottom surface 24, and eight equally spaced tunnels 0.25 (twenty-five hundredths) inch in diameter are used. Six holes 0.30 (thirty hundredths) inch in diameter were also tried and found to work satisfactorily. In this embodiment the outer wall is angled at about 25° (twenty-five degrees) from the vertical.

A pump using the impeller further includes a housing 40 which surrounds the impeller and includes chambers 42, 44, and 46 for receiving the oil thrown outwardly from tunnels 26. A seal 48 is disposed between the housing and an end plate 50 of the pump, with the seal and end plate being fastened to housing 40 by bolts 51. Holes 52 and 54 in the seal permit the fluid to flow from the chambers to a channel 56 in the end plate. The seal otherwise covers the end of the impeller and housing so that oil in the chambers can flow only into the channel. Seal 48 also contains a central opening 58 which is aligned with axial bore 18 in the assembled pump, and permits oil which enters channel 56 from the housing chambers to flow into and upwardly in the bore. Oil entry openings 60 and 62 in end plate 50 are aligned with oil entry openings 64 and 66 in the seal, thereby exposing annular inlet groove 22 to the oil in the sump when the impeller is immersed in the oil in the sump.

Centrifugal pumps utilizing the aforedescribed impeller have been found to have significantly greater head and flow performance when compared with comparable size pumps utilizing the aforeknown, symmetrically-shaped annular inlet grooves, and the pumps perform comparable to aforeknown centrifugal pumps utilizing radial vanes. The impellers of the present invention are preferable to impellers using previously known radial vanes in that the impeller can be fully machined in the end of the crankshaft, thereby eliminating the expense and inherent failure potential of pumps requiring the separate attachment of radial vanes.

Figure 7:
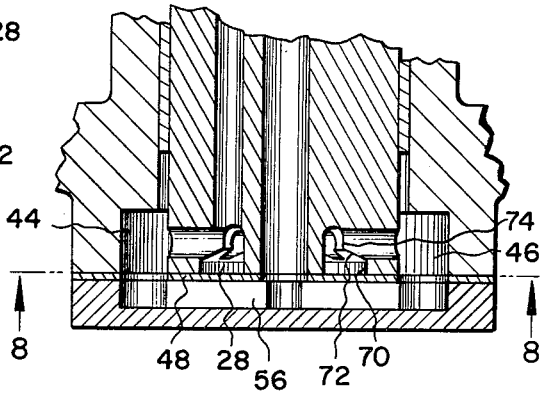
FIG. 7 is a cross-sectional view similar to that of FIG. 2, but showing a modified form of the invention.
Figure 8:
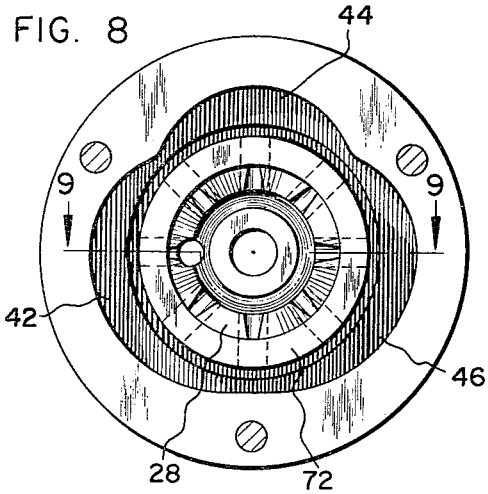
FIG. 8 is a cross-sectional view of the pump shown in FIG. 7, taken on line 8—8 of the latter figure.
Figure 9:
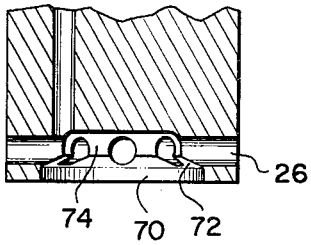
FIG. 9 is a cross-sectional view of the impeller shown in FIG. 8, taken on line 9—9 of FIG. 8.

The increased pump performance appears to be the result of exposing at least a portion of the tunnel walls to a flow of oil from directly below. Angling the outer side wall of the groove across the line of the tunnel creates this effect by opening the bottoms of the tunnels at their inner ends. The remaining exposed tunnel walls then act as vanes in scooping the oil and accelerating it to crankshaft speed. Other annular inlet groove shapes have been tried with varying results. The modified embodiment shown in FIGS. 7, 8, and 9 differs from that previously described herein only in the shape of the annular inlet groove. In this modified embodiment the outer wall includes a portion 70 substantially perpendicular to the end surface of the crankshaft, and extending from the end surface to near the plane defined by the lines of the tunnels 26 nearest to the end surface. The sidewall then angles inwardly over a section designated by numeral 72 to near a plane defined by the midlines of the tunnels. The remaining section 74 of the sidewall is again substantially perpendicular to the end of the crankshaft and extends to the concave subtending groove surface. Under some conditions the modified groove shape down in FIGS. 7, 8 and 9 outperforms that described previously in measured head and flow output; however, as a result of the difficulties in machining a groove precisely in the aforedescribed shape, the earlier disclosed form is generally preferred from a manufacturing viewpoint.

In yet another embodiment, shown in FIG. 10, the outer wall was made perpendicular to the end surface along a section 80 which extended from the end surface to near the midlines of the tunnels. The outer wall was angularly disposed along a section 82 from the midlines to the subtending groove surface. Initial testing indicated that this embodiment did not perform as well as the previously described embodiments of the invention; however, it did outperform the straight wall groove impellers used previously.

A possible explanation of the performance of the various designs for the groove rests in the surface area of the tunnels exposed to oil from directly below. The larger the surface area the larger the vane-like bodies disposed in the groove. Thus, the second embodiment, having a larger surface area of the tunnel exposed to oil flow from below outperformed the other two embodiments, and the third embodiment, which has the least amount of exposed tunnel wall surface area, was the least efficient of the three embodiments.

In the use and operation of a centrifugal oil pump embodying the present invention end plate 50, seal 48 and housing 40 are held together securely by bolts 51, and oil in sump 16 can flow through oil entry openings 60 and 62 and openings 64 and 66 of the end plate and seal respectively. Thus, the oil flows into the annular inlet groove 22; and, as the impeller turns, the oil is captured by the vane-like exposed tunnel walls, is quickly accelerated to the speed of the crankshaft, and the oil is thrown outwardly through tunnels 26. The oil collects in chambers 42, 44, and 46, and from the chambers, the oil flows through holes 52 and 54 of seal 48 into chamber 56 of end plate 50. The oil flows along channel 56, toward the center thereof, and passes through central opening 58 of the seal and rises in axial bore 18 of the crankshaft. Entrained refrigerant gases can collect above the tunnels in the area defined by the subtending groove surface, and from that area, the gases are permitted to escape through the vent passage.

In relatively slower operating compressors any of the impeller embodiments disclosed herein provide significantly greater head and flow output performance when compared with previously used symmetrically-shaped annular inlet groove pumps, and the present impellers have the additional advantage of being completely machinable in the end of the crankshaft, thereby eliminating the need for separate manufacture of the crankshaft and impeller and the then required attachment thereof. Since the angular radial vanes are not required, the danger of damage from vane detachment is eliminated. Further, the impellers disclosed herein operate equally well in either direction of crankshaft rotation, thereby eliminating the possibility of compressor damage resulting from improper installation and reverse direction operation of the compressor.

Although one embodiment and several modifications for a centrifugal pump impeller have been shown and described in detail herein, various other changes may be made without departing from the scope of the present invention.

I claim:

1. A centrifugal oil pump having improved head and flow performance comprising a generally clindrical body having a longitudinal bore therein for transmitting oil upwardly by centrifugal force, said bore having an opening in the end of said body, and said body being rotatable about a longitudinal axis; a plurality of radially extending tunnels disposed in said body having outlets in the periphery of said body and having inlets inwardly in said body from said end of said body and between said bore and said periphery; an annular oil inlet groove having a groove opening in said end of said body, a subtending groove surface defined the depth of said groove, said subtending groove surface being narrower than said groove opening, and inner and outer side walls defining the width of said groove, said groove intersecting said tunnels and communicating with said tunnels along at least a portion of the longitudinal extent of the tunnels, said outer side wall being of a shape to cause at least some of the loci defined by the intersection of said groove and a tunnel to each include a portion disposed at an acute angle with respect to the axis of the tunnel defining the locus, thereby opening the bottom of the tunnel and exposing a part of the tunnel to a flow of fluid from directly therebelow, and permitting the upper portion of the inner end of the tunnel to function substantially as a vane; a housing having a chamber for receiving oil thrown outwardly from said tunnels; and an end plate having a channel for receiving oil from said chamber and for directing oil to said opening of said bore.

2. A centrifugal oil pump as defined in claim 1 in which said outer side wall of said groove angles inwardly along substantially its entire length.

3. A centrifugal oil pump as defined in claim 1 in which said outer side wall angles inwardly in said body over a part of its length.

4. A centrifugal oil pump as defined in claim 1, 2, or 3 in which said subtending surface is concave.

5. A centrifugal oil pump as defined in claim 4 in which said tunnels are equally spaced in said body and intersect said groove between said opening and said subtending surface, and a vent passage is disposed in said body from the periphery thereof to said subtending surface.

6. A centrifugal oil pump as defined in claim 1 in which said outer side wall angles inwardly from near a plane defined by points of said tunnels nearest said end of said body to near a plane defined by the midlines of said tunnels.

7. A centrifugal oil pump as defined in claim 6 in which said subtending surface is concave.

8. A centrifugal oil pump as defined in claim 7 in which said tunnels are equally spaced in said body and intersect said groove between said opening and said subtending surface, and a vent passage is disposed in said body from the periphery thereof to said subtending surface.

9. A centrifugal oil pump impeller for improving head and flow performance comprising a generally cylindrically shaped body rotatable about a generally vertical oriented longitudinal axis; a bore having an opening in the bottom end of said body and extending upwardly in said body; a plurality of tunnels having inlets radially outward from said bore and outlets in the periphery of said body; and an annular inlet groove having a groove opening in said end of said body, a subtending groove surface defining the depth of said groove and inner and outer groove side walls extending from said opening to said subtending surface; said annular inlet groove communicating with said tunnels along a part of the longitudinal extent of the tunnels, and communicating therewith from below said part of said tunnels longitudinal extent, opening the bottoms of said tunnels and exposing the upper portions of the inner ends of said tunnels to fluid flow from directly therebelow, said inlets being loci defined by the intersection of said groove and said tunnels, said loci each having at least a portion disposed at an acute angle to the axis of the tunnel defining its boundaries.

10. A centrifugal oil pump impeller as defined in claim 9 in which said outer side wall angles inwardly from said groove opening to said subtending groove surface.

11. A centrifugal oil pump impeller as defined in claim 9 in which said outer side wall angles inwardly from near a plane defined by the points of said tunnels nearest said end of said body to near the midlines of said tunnels.

12. A centrifugal oil pump impeller as defined in claim 9, 10 or 11 in which said subtending surface is concave.

13. A centrifugal oil pump impeller as defined in claim 12 in which a vent passage is disposed in said body between said subtending surface and said body periphery.

14. In a two-stage centrifugal oil pump impeller of the type found in reciprocating compressors for operating at the end of a substantially vertically oriented crankshaft submerged in oil in a sump, and having a plurality of radially extending tunnels for conveying oil to the perimeter of the impeller; an inlet means for providing oil to said tunnels and improving the head and flow performance of the pump, said means comprising an annular inlet groove having an annular opening in the bottom end of the shaft; a subtending groove surface narrower than said opening; and inner and outer sidewalls; said groove intersecting said tunnels to form loci each defined by the area of intersection between said groove and one of said tunnels, at least a part of each of said loci being disposed at an acute angle with respect to the axis of the tunnel defining it, thereby opening the bottom of the tunnel at the inner end and exposing at least a part of the tunnel to oil flow from directly therebelow.

15. The invention of claim 14 in which said outer side wall angles inwardly over substantially its entire length.

16. The invention of claim 14 in which said outer side wall angles inwardly over a part of its length.

17. The invention of claim 14, 15, or 16 in which said subtending surface is concave.

18. The invention of claim 14 in which said outer side wall angles inwardly from near a plane defined by the points of said tunnels nearest the end of the shaft to near the axes of said tunnels.

19. The invention of claim 18 in which said subtending surface is concave.

* * * * *